US005752903A

United States Patent [19]

Chang

[11] Patent Number: 5,752,903

[45] Date of Patent: May 19, 1998

[54] EXERCISE BAR ASSEMBLY

[76] Inventor: Sreter Chang, No. 451, Ta Tien Road, Homei Chen, Chang Hua Hsien, Taiwan

[21] Appl. No.: 745,622

[22] Filed: Nov. 8, 1996

[51] Int. Cl.[6] ..... A63B 23/12; A63B 23/02; A63B 1/00

[52] U.S. Cl. ..... 482/141; 482/140; 482/40

[58] Field of Search ..... 482/140, 141, 482/904, 38, 39, 40

[56] References Cited

U.S. PATENT DOCUMENTS

| | | | |
|---|---|---|---|
| 4,529,191 | 7/1985 | Miller | 482/40 |
| 5,417,628 | 5/1995 | Vanderbleek | 482/40 |
| 5,492,520 | 2/1996 | Brown | 482/140 |
| 5,527,252 | 6/1996 | Sather | 482/141 |
| 5,577,989 | 11/1996 | Brown | 482/140 |
| 5,591,111 | 1/1997 | Wang | 482/140 |

*Primary Examiner*—Jerome Donnolly
*Assistant Examiner*—William LaMarca
*Attorney, Agent, or Firm*—Beveridge, DeGrandi, Weilacher & Young, L.L.P.

[57] ABSTRACT

An exercise bar assembly for use as a push up device, sit up device and a hanging bar includes a shaft with first and second ends, first and second C-shaped handles disposed on the shaft, an inner pipe enclosing a middle portion of the shaft, an outer pipe enclosing the inner pipe and a hollow outer sleeve enclosing the outer pipe.

3 Claims, 5 Drawing Sheets

EXERCISE BAR ASSEMBLY

BACKGROUND OF THE INVENTION

The invention relates to an exercise bar assembly. More particularly, the invention relates to an exercise bar assembly for various exercising purposes.

Most conventional exercise devices have simple training functions and purposes. One type of exercise device cannot be converted to the other type of exercise device. If an exercise device provides many different training functions, the exercise device should have complex structure. Thus the complex exercise device may be very expensive. It is very difficult to familiarize the operation of the complex exercise.

SUMMARY OF THE INVENTION

An object of the invention is to provide an exercise bar assembly for various exercising purposes.

Accordingly, an exercise bar assembly comprises a shaft, a first and second C-shaped handles disposed on the shaft, an inner pipe enclosing a middle portion of the shaft, an outer pipe enclosing the inner pipe, and a hollow outer sleeve enclosing the outer pipe. The shaft has a first and second ends. The outer pipe has a center hole to receive the inner pipe. The inner pipe has an aperture to receive a screw and a square hole to receive the shaft. A threaded end is formed on an end of the inner pipe. A screw passes through the aperture to fasten the inner pipe and the shaft. The first C-shaped handle has a first and second arc arms. A first and second casings enclose the first and second arc arms respectively. The second C-shaped handle has a third and fourth arc arms. A third and fourth casings enclose the third and fourth arc arms respectively. A first seat has a first through slot to receive the shaft, a first threaded hole formed beneath the first seat, a first groove and a plurality of first recess holes formed on the first seat. A first cover has a first recess and a plurality of first through holes. A first middle portion of the first C-shaped handle is inserted in the first groove. The first cover covers the first middle portion of the first C-shaped handle. A plurality of first bolts pass through the corresponding first through holes and first recess holes to fasten the first cover and the first seat. A first threaded button fastens the first seat and the shaft together via the first threaded hole. A second seat has a second through slot to receive the shaft, a second threaded hole formed beneath the second seat, a second groove and a plurality of second recess holes formed on the second seat. A second cover has a second recess and a plurality of second through holes. A second middle portion of the second C-shaped handle is inserted in the second groove. The second cover covers the second middle portion of the second C-shaped handle. A plurality of second bolts pass through the corresponding second through holes and second recess holes to fasten the second cover and the second seat. A second threaded button fastens the second seat and the shaft together via the second threaded hole. A retaining ring has a threaded inner hole to receive the threaded end of the inner pipe.

DETAILED DESCRIPTION OF THE INVENTION

Figure 1:
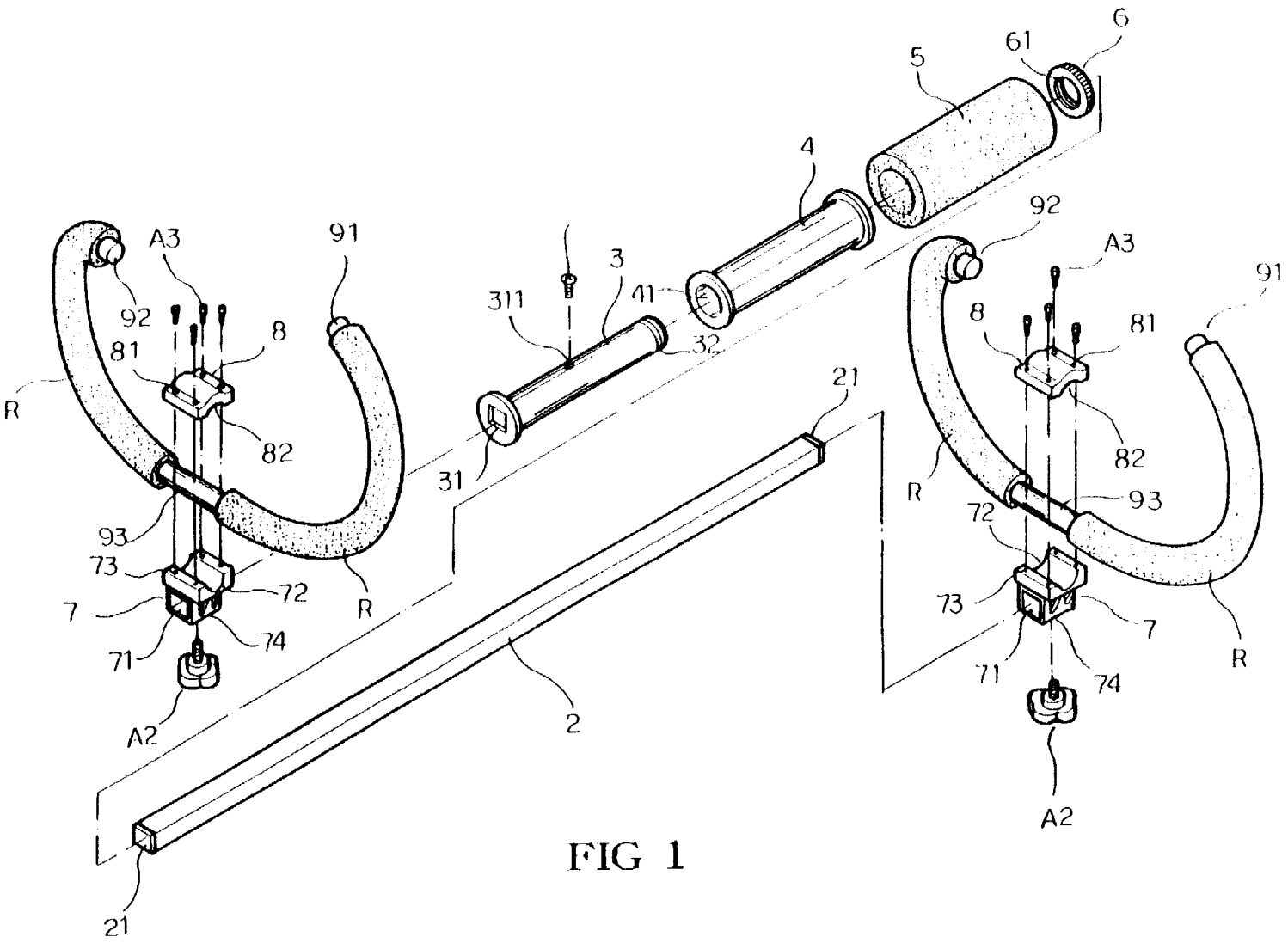
FIG. 1 is a perspective exploded view of an exercise bar assembly of a preferred embodiment in accordance with the invention.
Figure 2:
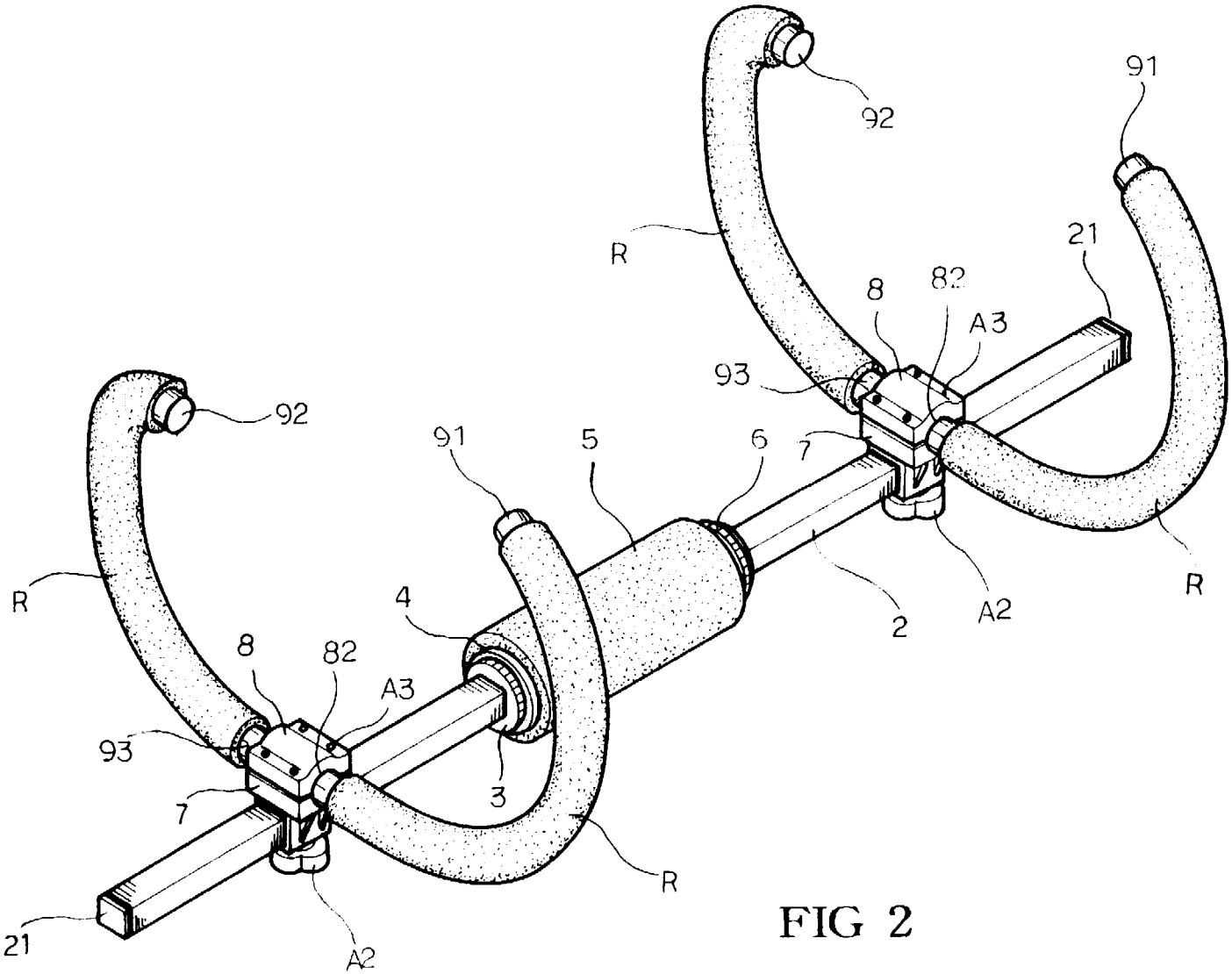
FIG. 2 is a perspective assembly view of an exercise bar assembly of a preferred embodiment in accordance with the invention.
Figure 3:
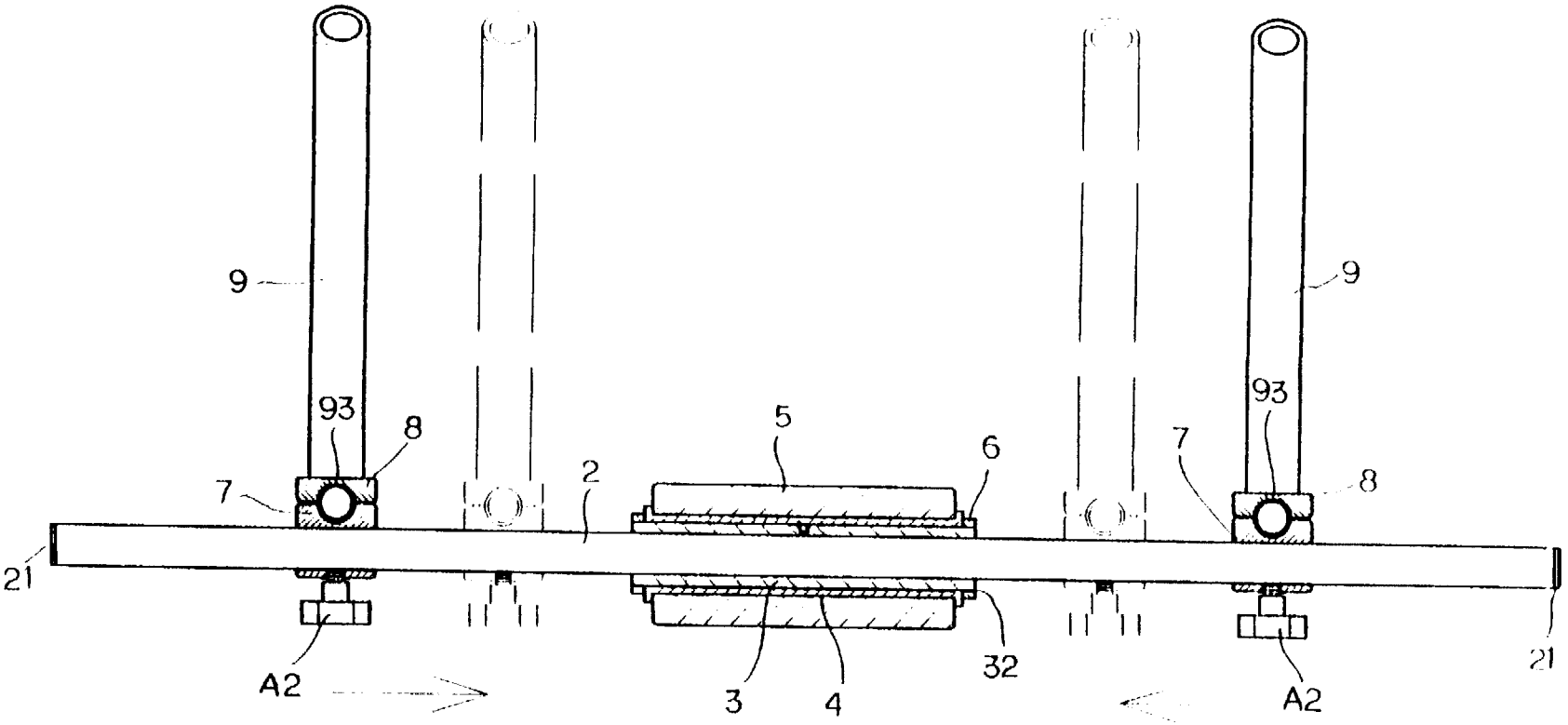
FIGS. 3 is a schematic view illustrating an assembly of an exercise bar assembly.

Referring to FIGS. 1 to 3, an exercise bar assembly comprises a shaft 2, a first and second C-shaped handles 9 disposed on the shaft 2, an inner pipe 3 enclosing a middle portion of the shaft 2, an outer pipe 4 enclosing the inner pipe 3, and a hollow outer sleeve 5 enclosing the outer pipe 4. The shaft 2 has a first and second ends 21.

The hollow outer sleeve 5 is made of foamed plastics. The outer pipe 4 has a center hole 41 to receive the inner pipe 3. The inner pipe 3 has an aperture 311 to receive a screw A1 and a square hole 31 to receive the shaft 2. A threaded end 32 is formed on an end of the inner pipe 3. A screw A1 passes through the aperture 311 to fasten the inner pipe 3 and the shaft 2.

The first C-shaped handle 9 has a first and second arc arms 91. A first and second casings R enclose the first and second arc arms 91 respectively. The second C-shaped handle 9 has a third and fourth arc arms 91. A third and fourth casings R enclose the third and fourth arc arms 91 respectively.

A first seat 7 has a first through slot 71 to receive the shaft 2, a first threaded hole 74 formed beneath the first seat 7, a first groove 72 and a plurality of first recess holes 73 formed on the first seat 7. A first cover 8 has a first recess 82 and a plurality of first through holes 81. A first middle portion 93 of the first C-shaped handle 9 is inserted in the first groove 72. The first cover 8 covers the first middle portion 93 of the first C-shaped handle 9. A plurality of first bolts A3 pass through the corresponding first through holes 81 and first recess holes 73 to fasten the first cover 8 and the first seat 7. A first threaded button A2 fastens the first seat 7 and the shaft 2 together via the first threaded hole 74.

A second seat 7 has a second through slot 71 to receive the shaft 2, a second threaded hole 74 formed beneath the second seat 7, a second groove 72 and a plurality of second recess holes 73 formed on the second seat 7. A second cover 8 has a second recess 82 and a plurality of second through holes 81. A second middle portion 93 of the second C-shaped handle 9 is inserted in the second groove 72. The second cover 8 covers the second middle portion 93 of the second C-shaped handle 9. A plurality of second bolts A3 pass through the corresponding second through holes 81 and second recess holes 73 to fasten the second cover 8 and the second seat 7. A second threaded button A2 fastens the second seat 7 and the shaft 2 together via the second threaded hole 74.

A retaining ring 6 has a threaded inner hole 61 to receive the threaded end 32 of the inner pipe 3.

Figure 4:
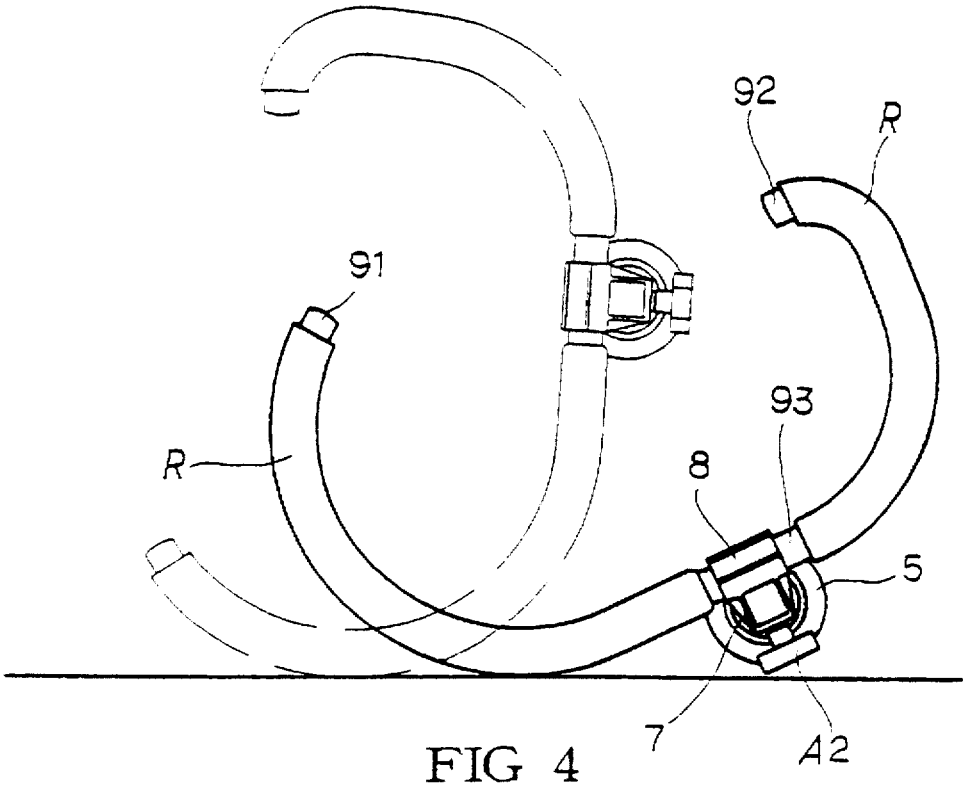
FIGS. 4, 5 and 6 are schematic views illustrating the operation of an exercise bar assembly.

Referring to FIG. 4, the exercise bar assembly can be used as a sit-up exercise device.

Figure 5:
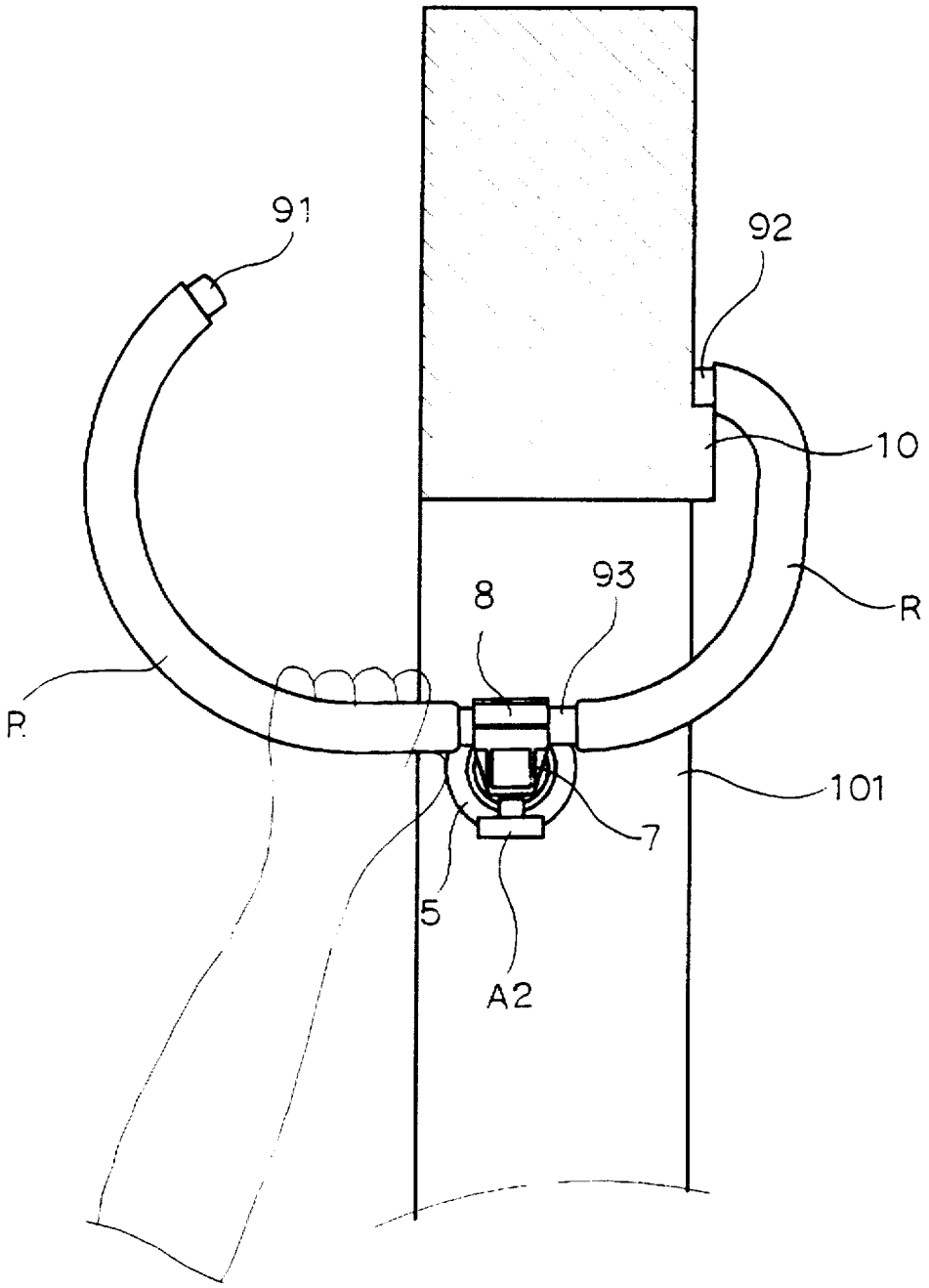

Referring to FIG. 5, the exercise bar assembly can be used as a hanging bar device.

Figure 6:
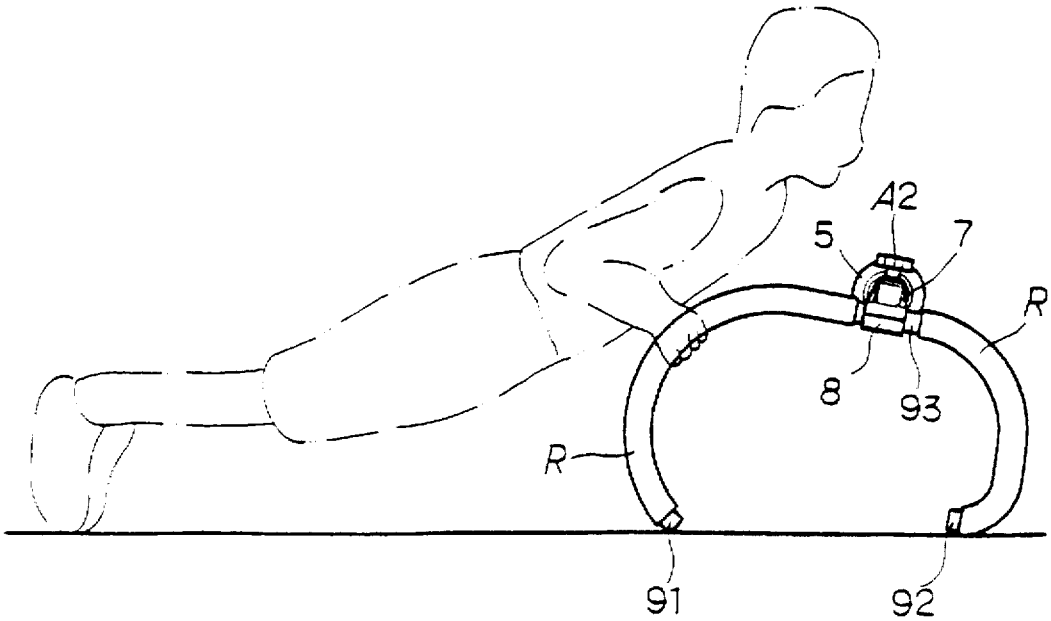

Referring to FIG. 6, the exercise bar assembly can be used as a push-up exercise device.

The invention is not limited to the above embodiment but various modification thereof may be made. Further, various changes in form and detail may be made without departing from the scope of the invention.

I claim:

1. An exercise bar assembly comprising:

a shaft having a first and second end, first and second C-shaped handles disposed on the shaft, an inner pipe enclosing a middle portion of the shaft, an outer pipe enclosing the inner pipe, and a hollow outer sleeve enclosing the outer pipe, the outer pipe having a center hole to receive the inner pipe, the inner pipe having a square hole to receive the shaft, a threaded end formed on an end of the inner pipe, the first C-shaped handle having first and second arc arms, first and second casings enclosing the first and second arc arms respectively, the second C-shaped handle having third and fourth arc arms, third and fourth casings enclosing the third and fourth arc arms respectively, a first seat having a first through slot to receive the shaft, a first threaded hole formed beneath the first seat, a first groove and a plurality of first recess holes formed on the first seat, a first cover having a first recess and a plurality of first through holes, a first middle portion of the first C-shaped handle inserted in the first groove, the first cover covering the first middle portion of the first C-shaped handle, a plurality of first bolts passing through the corresponding first through holes and first recess holes to fasten the first cover and the first seat respectively, a first threaded button fastening the first seat and the shaft together via the first threaded hole, a second seat having a second through slot to receive the shaft, a second threaded hole formed beneath the second seat, a second groove and a plurality of second recess holes formed on the second seat, a second cover having a second recess and a plurality of second through holes, a second middle portion of the second C-shaped handle inserted in the second groove, the second cover covering the second middle portion of the second C-shaped handle, a plurality of second bolts passing through the corresponding second through holes and second recess holes to fasten the second cover and the second seat, and a second threaded button fastening the second seat and the shaft together via the second threaded hole.

2. An exercise bar assembly as claimed in claim 1, wherein a retaining ring has a threaded inner hole to receive the threaded end of the inner pipe.

3. An exercise bar assembly as claimed in claim 1, wherein a screw fastens the inner pipe and the shaft together.

* * * * *